US005632707A

United States Patent [19]

Daniel et al.

[11] Patent Number: 5,632,707

[45] Date of Patent: May 27, 1997

[54] UPPER TORSO EXERCISER

[76] Inventors: Antonio Daniel, P.O. Box 144948, Coral Gables; Jesus Sanchelima, 235 SW. Le Jeune Rd., Miami, both of Fla. 33134

[21] Appl. No.: 723,083

[22] Filed: Sep. 30, 1996

[51] Int. Cl.[6] ..... A63B 26/00

[52] U.S. Cl. ..... 482/8; 482/95; 482/117; 482/132; 482/141

[58] Field of Search ..... 482/7, 8, 95, 141, 482/146, 147, 132, 909, 900, 96, 106, 108, 117, 126, 136, 137, 148

[56] References Cited

U.S. PATENT DOCUMENTS

| | | | |
|---|---|---|---|
| 1,824,920 | 9/1931 | Novak | 482/132 |
| 3,115,338 | 12/1963 | Acs et al. | 482/141 |
| 3,796,431 | 3/1974 | Sinyard | 482/132 |
| 3,809,393 | 5/1974 | Jones | 482/132 |
| 4,495,813 | 1/1985 | Lojko et al. | 482/909 |
| 5,358,463 | 10/1994 | Fuentes | 482/141 |

*Primary Examiner*—Richard J. Apley
*Assistant Examiner*—Glenn E. Richman
*Attorney, Agent, or Firm*—J. Sanchelima

[57] ABSTRACT

A device for exercising a user's upper torso that utilizes a minimum of space. A wheeled housing is provided with a handle member providing an effective grip to a user who will lean his or her body's weight against the device is coupled to one or more of the wheels to display the amount of rotation of the wheels thereby giving an indication to a user of the amount of exercise undertaken. A reader of the movement of the device has an output connected to a counter/display that is resettable. The reader is mounted in a spring loaded cavity so that an effective outwardly force brings its ball member in contact with the surface.

5 Claims, 2 Drawing Sheets

UPPER TORSO EXERCISER

II. BACKGROUND OF THE INVENTION

1. Field of the Invention

The present invention relates to an upper torso exerciser, and more particularly to the type that a user applies his or her own weight for the exercises.

2. Description of the Related Art

There are many exercising devices of different types for exercising a person's upper torso. Most of them involve rather complicated voluminous apparatus such as, chest expander units found in most gyms. The present invention, on the other hand, permits a user to exercise his or her upper torso with a volumetrically efficient and simple device.

III. SUMMARY OF THE INVENTION

It is one of the main objects of the present invention to provide a device that permits a user to improve his or her muscles in the upper torso portion of the body.

It is another object of this invention to provide a device that includes a distance reader for tracking the distance traveled by the device caused by the movements.

It is still another object of the present invention to provide a device that is volumetrically efficient for storage and transporting.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
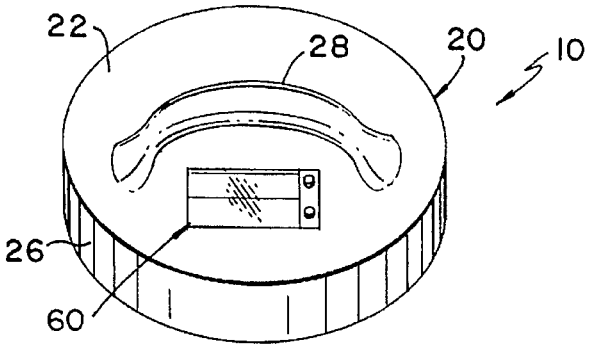
FIG. 1 is an isometric view of a preferred embodiment for the present invention from the top.
Figure 2:
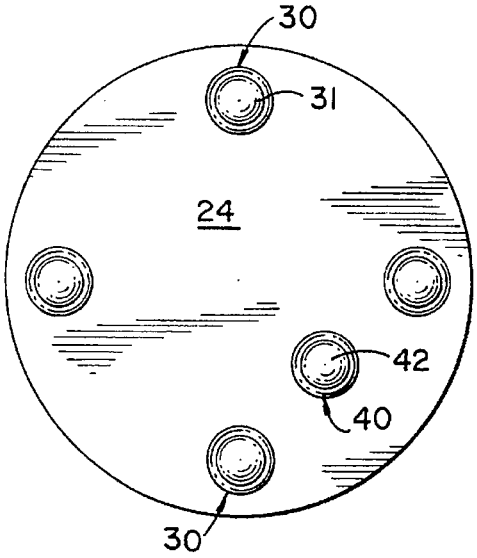
FIG. 2 is a bottom view of this invention shown in the previous figure.

Referring now to the drawings, where the present invention is generally referred to with numeral 10, it can be observed that it basically includes exerciser housing assembly 20 with grip member 28 rigidly mounted thereto, four steel ball transfer assemblies 30 and track ball assembly 40.

Figure 3:
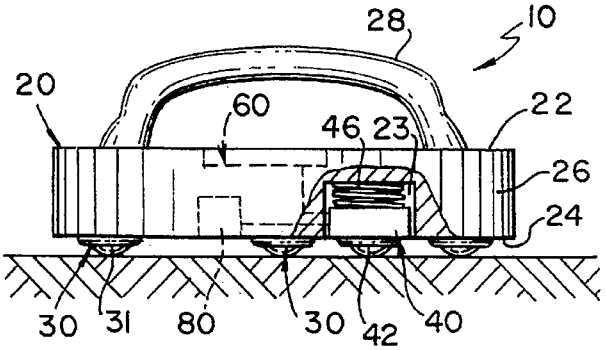
FIG. 3 is an elevational view of this invention with a partial cross section showing the track ball assembly.
Figure 4:
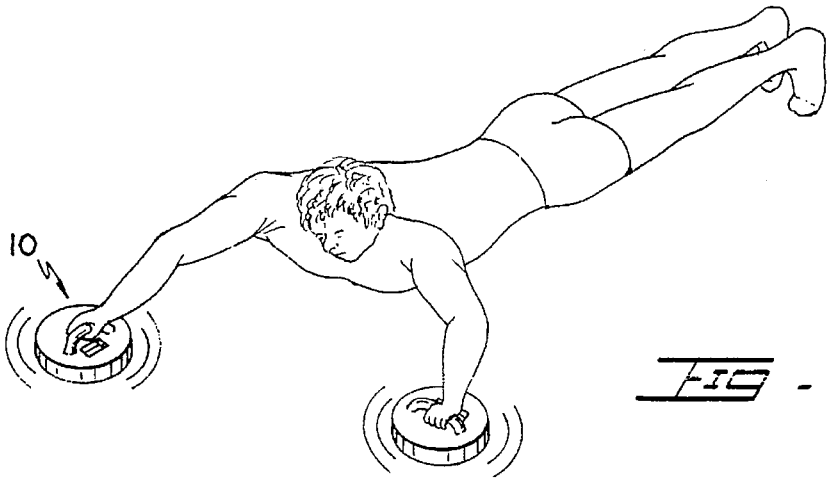
FIG. 4 is a representation of an application of the present invention.
Figure 5:
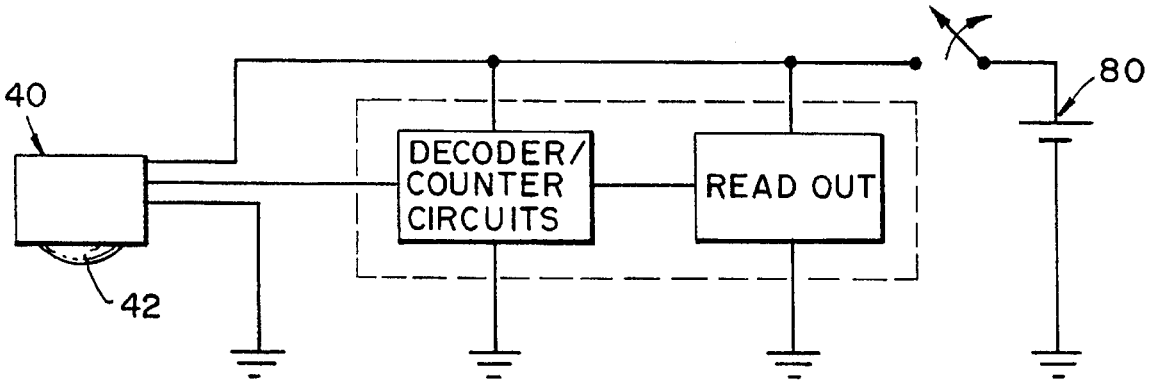
FIG. 5 is a block diagram representation of the circuit used in the preferred embodiment.

Exerciser housing assembly 20, in the preferred embodiment, includes upper surface 22, lower surface 24 and peripheral wall 26. A user grabs device 10 through grip member 28 leaning on it. Exerciser housing assembly 20 also includes four steel ball transfer assemblies 30 mounted to lower surface 24. Assemblies 30 have ball members 31 which partially protrude from lower surface 24, as best seen in FIG. 3. Assemblies 30 permit device 10 to be moved freely in rotational and lineal directions since assemblies 30 are multi-directional, as shown in FIG. 4. Assemblies 30 could be implemented with steel ball transfer assemblies such as stud mount model M1900 distributed by Grainger, 2255 N. W. 89th Place, Miami, Fla. 33122.

Track ball assembly 40, in the preferred embodiment, is partially housed within housing assembly 20 and ball members 42 protrude from upper surface 22. Ball member 42 detects the movement of upper torso device 10. Ball member 42 is partially housed within assembly 40 which in turn is mounted inside cavity 23 of housing assembly 20. Spring member 46 is also housed within cavity 23 pushing assembly 40 outwardly toward the supporting surface. The characteristics of spring member 46 are such that a sufficient force is exerted on assembly 40 to cause ball member 42 to effectively roll when device 10 is moved. Track ball assembly 40 can be implemented using series 225 Trackball manufactured by Damaher Controls.

The output of track ball assembly 40 is connected to counter/display assembly 60 which decodes the output signal of the former. Counter/display assembly 60 has a digital display that shows the distance traveled by device 10 during the exercise session. Assembly 60 can be implemented with Model C346 marketed under the brand Veedor-Root by Damaher Controls, 1675 Delany Road, Gurnee, Ill. 60031-1282. A suitable battery assembly 80 is provided to power assemblies 40 and 60. The display of assembly 60 is resettable and more elaborate circuitry can be provided to record and analyze the movement history of device 10, such as adding memory circuitry and output interface. However, only the pioneering inventive concepts are claimed in the present application since these additional improvements are to be considered for production and final units depending on the pertinent marketing studies.

There are other means for reading the movements of device 10, such as those that optically or magnetically read the rotation of wheels 30. But, it is believed that by achieving an effective contact of ball member 42 to the surface a more practical implementation is obtained.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An exercise device that is moved over a flat surface, comprising:

A) housing means;

B) handle means mounted to said housing means; and

C) wheel means mounted to said housing opposite to said handle means;

D) means for reading the movement of said device over said flat surface; and

E) counter means for displaying the magnitude of the movement of said device.

2. The device set forth in claim 1 wherein said housing means includes upper and lower walls spaced apart and disposed substantially parallel to each other, said handle means is mounted to said upper wall, said wheel means is mounted to said lower wall.

3. The device set forth in claim 2 wherein said counter means is resettable.

4. The device set forth in claim 3 wherein said track ball assembly is partially housed within said housing means; means for reading the movement of said device over said surface; counter means for displaying the magnitude of the movement of said device; said means for reading the movement of said device comprises a track ball assembly that includes a ball member that comes in contact with said surface thereby tracking the movement of said device.

5. The device set forth in claim 4 wherein said track ball assembly is mounted to said housing means by spring means so that a predetermined outwardly force is applied to said track ball assembly thereby achieving effective contact with said surface.

* * * * *